United States Patent [19]

Ambasz

[11] Patent Number: 4,729,686

[45] Date of Patent: Mar. 8, 1988

[54] FLEXIBLE PEN WITH SLIDING SLEEVE

[76] Inventor: Emilio Ambasz, 295 Central Park West, New York, N.Y. 10024

[21] Appl. No.: 50,617

[22] Filed: May 15, 1987

[51] Int. Cl.[4] ..... B43K 9/00; B43K 7/00

[52] U.S. Cl. ..... 401/117; 401/116; 401/209; 401/214

[58] Field of Search ..... 401/116, 117, 209, 214

[56] References Cited

U.S. PATENT DOCUMENTS 4,580,919 4/1986 Ambasz ..... 401/117

4,679,954 7/1987 Ambasz ..... 401/117

*Primary Examiner*—Steven A. Bratlie

*Attorney, Agent, or Firm*—Brumbaugh, Graves, Donohue & Raymond

[57] ABSTRACT

A pen comprises an elongated one-piece barrel having substantially rigid tip end and head end portions joined to each other by an intermediate integral flexible portion, whereby the barrel can be bent at the flexible portion, and a writing tip at the distal end of the tip end portion. A substantially rigid tubular cap member is telescopically received over the tip end portion of the barrel such that it can be moved along the barrel between (1) a retracted position in which it overlies part of the tip end portion and substantially all of the flexible portion, thus exposing the writing tip for use and rendering the pen substantially rigid, and (2) an extended position in which it covers the writing tip and leaves the flexible portion exposed, thus protecting the writing tip and rendering the pen flexible. Interengaging coupling elements on the cap and the tip end portion of the barrel releasably retain the cap member in each of the retracted and extended positions. Longitudinal movement of the cap member is controlled by vestigial threads on the barrel that are formed by rows of helical ribs on opposite sides of the tip end portion and that interact with internal protrusions on the cap member.

4 Claims, 10 Drawing Figures

FLEXIBLE PEN WITH SLIDING SLEEVE

BACKGROUND OF THE INVENTION

Pens come in a variety of types, shapes and sizes and range in cost from as little as a few cents to several hundred dollars. The present invention relates to an inexpensive pen.

Relatively low cost ball-point pens can be found in both the retractable type, in which the writing tip extends from and retracts into a barrel, for example, by pressing in a push button at the head end of the barrel or by rotating one portion of the barrel relative to another portion, and the fixed type, some of which have removable caps, in which the writing tip is permanently affixed to the barrel. Generally, the retractable types are somewhat more costly to produce and, therefore, more expensive than the fixed types. The retractable types are generally preferable from the point of view of being transportable in a pocket or purse, inasmuch as the writing tip can be retracted and will not, therefore, deface a pocket or purse or objects in them. The detachable caps of fixed type ball-point pens tend to get lost. Moreover, the barrel of a pen with a detachable cap can easily become detached from the cap when the pen is carried in a pocket or purse, in which case a shirt can be ruined or items in a purse or pocket defaced.

Ball-point pens, and for that matter all writing instruments, are not particularly convenient to carry, but most people like to carry a pen anyway. When clipped to a shirt pocket or coat pocket, a pen can poke or press against the wearer from time to time. Some pockets are not deep enough to fully accept the pen. There is often not enough room in small compartments of purses or in small change purses to receive the conventional ball-point pen.

In recognition of a long felt need for an inexpensive pen that can be carried easily on the person or in small purses with the writing tip protected by a non-detachable cap and at the same time having a size and shape that are conventional and customary for normal writing, the present inventor has previously invented a ball-point pen that is, in a sense, of the retractable type, in that the writing tip is exposed in one configuration and covered and protected in another configuration. In another sense, it is not a retractable type, inasmuch as there is no retraction mechanism for moving the writing tip into and out of the barrel, the writing tip being affixed to the barrel. The pen of that invention is flexible when in the configuration in which the writing tip is covered and protected but is rigid when the tip is uncovered for use. The flexibility of the pen in the configuration when the tip is covered and protected allows the pen to bend when placed in a pocket or a purse so that it can fit conveniently into small pockets and purses and so that it can yield and thereby be more comfortable when carried on the person. Reference may be made to U.S. Pat. No. 4,580,919 issued Apr. 8, 1986 and to U.S. Pat. No. 4,679,954 for disclosures of the basic invention and an improvement, respectively.

The pen referred to above comprises an elongated one-piece barrel having substantially rigid tip end and head end portions joined to each other by an intermediate integral flexible portion, whereby the barrel can be bent at the flexible portion, and a writing tip at the distal end of the tip end portion. A substantially rigid tubular cap member is received telescopically over the tip end portion of the barrel in a manner such that it can be moved along the barrel between (1) a retracted position in which it overlies part of the tip end portion and substantially all of the flexible portion, thus rendering the pen substantially rigid, and (2) an extended position in which it covers the writing tip and leaves the flexible portion exposed, thus protecting the writing tip and rendering the pen flexible. The cap and barrel have interengaging coupling elements that releasably retain the cap member in each of the retracted and extended positions.

In one form (U.S. Pat. No. 4,580,919) the cap member is free to move both rotationally and longitudinally between the extended and retracted positions. It has been observed that when the cap member releases from the retained positions, which requires some amount of force, it may move very rapidly to the other position and then be stopped abruptly. Such abrupt actions can be disconcerting to the user, particularly a user who is not familiar with the pen.

The improvement U.S. Pat. No. 4,679,954 alleviates the tendency for rapid movement by changing the direction of the releasing force from longitudinal to rotational—thus the force to enable shifting of the cap does not result in rapid lengthwise movement. Furthermore, the improvement translates the rotational releasing force on the cap to longitudinal movement by means of slanted portions of the control grooves.

As not infrequently occurs, the solution of one problem creates another, albeit a minor one, as in this case. The improved design requires a precise pattern of rotational and longitudinal motions of the cap to move it between the retracted and extended retained positions. Again, it is the novice user who can encounter minor difficulty; the conditioned user can perform the motions by second nature.

It goes without saying that threaded members are well-known for providing linear motion in response to rotational forces, and threaded elements, including protective caps, removable and non-removable, are known in pens and other writing instruments. The disadvantage of threads is that they are not easy to form. Ordinarily, they are machined, because the tooling to cast or mold them is relatively complicated.

SUMMARY OF THE INVENTION

The present invention is a further improvement in the pen of the aforementioned patent and patent application, namely an arrangement of the barrel and cap member that provides controlled longitudinal movements of the cap member between the extended and retracted positions in response to solely unidirectional rotational motion. In particular the invention is characterized in that the tip end portion of the barrel includes a threaded portion extending from a juncture with the flexible portion to a terminus spaced-apart from the distal end, the threaded portion having on opposite sides longitudinal rows of spaced-apart helical ribs, the external surfaces of which are in close sliding fit with the internal wall surface of the cap member. The ribs of the respective rows are shaped and located to define vestigial helical threads. The cap member has at generally its longitudinal center a circumferential row of equally spaced-apart protrusions extending inwardly from its internal wall, the protrusions being adapted to be received sequentially in the vestigial threads to engage and follow them and provide controlled longitudinal movement of the cap member along the threaded portion upon rotation of the cap member relative to the barrel.

In a preferred embodiment the cap member is releasably retained in the respective retracted and extended positions by constrictions in the threads closely adjacent the ends thereof, the constrictions being in interference fit with the protrusions such as to require forced elastic deformations of portions of the cap member and barrel to enable the protrusions to pass the constrictions. The constrictions may be in the form of shallow parts of the threads—in other words, beads at the bases of the thread grooves—that force elastic stretching of the cap member in the region of the protrusions to enable the protrusions to pass the constrictions.

The invention is, optimally, further characterized in that a tubular retainer member is received on the tip end portion of the barrel. The retainer provides a shoulder at the terminus of the threaded portion that blocks the distal ends of the threads and prevents removal of the cap member. The retainer member is installed on the barrel after the cap member is threaded onto the barrel.

The two rows of ribs on opposite sides of the barrel enable the formation of vestigial threads—i.e. threads that are twice interrupted in each revolution of their circumferential extents—by molding from a polymeric material with relatively simple tooling. The ribs can be molded by a three-part mold having two moving parts that open and close in opposed relation around a mandrel along a parting plane orthogonal to a common axis along which the parts move and including the axis of the mandrel. The mold also forms the rib elements that constitute the flexible portion of the one piece barrel. Accordingly, the barrel can be made at a very low cost, because it is molded in one-piece and requires no machining or other operation (apart from possible sand blasting, other minor finishing, printing and the like) to complete it.

Likewise, the cap member is easy to make by molding from a polymeric material using a mold having two moving parts that form the internal surface and that part along a plane perpendicular to the axis at the location of the internal protrusions. The protrusions are formed by mating notches at the edges of elements of the moving mold parts.

For a better understanding of the invention reference may be made to the following description of an exemplary embodiment, taken in conjunction with the accompanying drawings.

DESCRIPTION OF THE EMBODIMENT

Apart from the improvements involving the thread construction of the tip part of the barrel, the following projections on the cap member, and the addition of a retainer member, the embodiment is substantially identical to the pens described and shown in U.S. Pat. Nos. 4,580,919 and 4,679,954 referred to above. Reference may be made to those patents, which are hereby incorporated herein by this reference to them, for detailed descriptions of the present embodiment.

Figure 1:
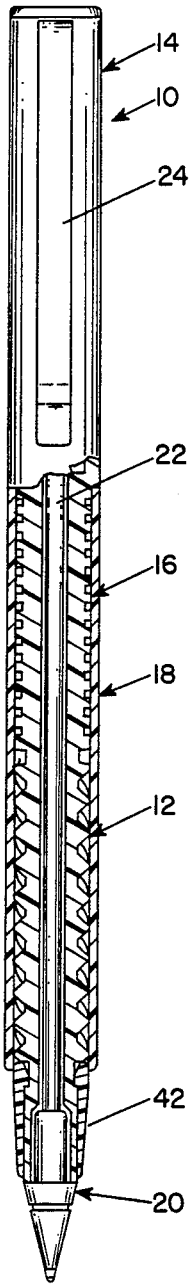
FIG. 1 is a front elevational view of the embodiment, partly broken away in cross-section, and shows the cap in the retracted position.
Figure 2:
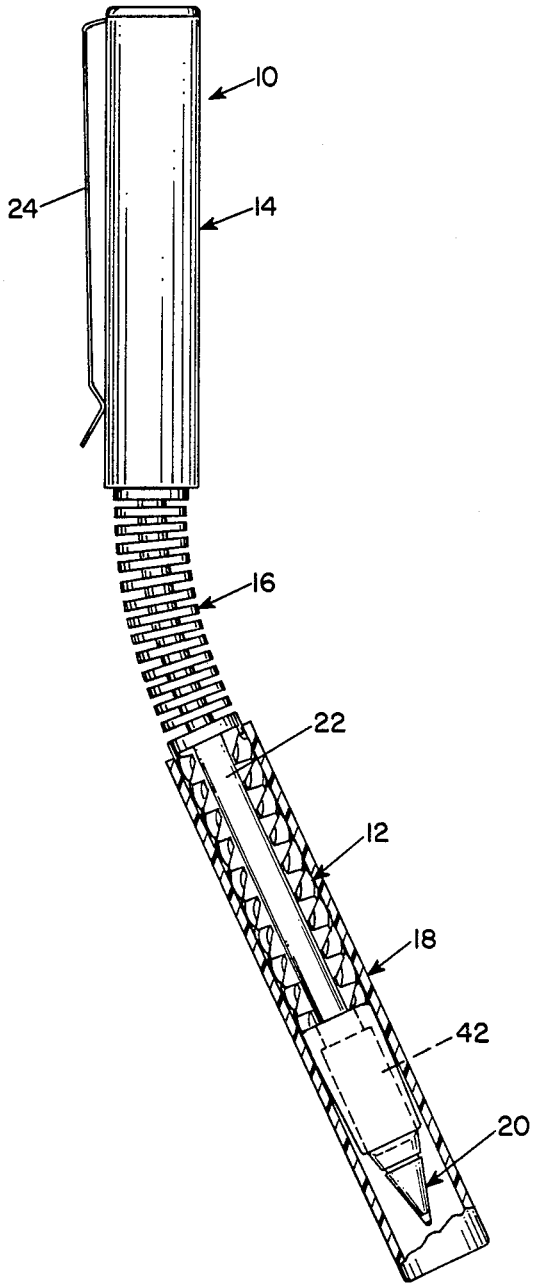
FIG. 2 is a side elevational view of the embodiment, partly broken away in cross-section, and shows the cap member in the extended position.

Briefly, the embodiment comprises a one-piece barrel 10 molded from a polymeric material and comprising substantially rigid tip end and head end portions 12 and 14 joined by an intermediate flexible portion 16. A tabular cap number 18 is slidably received on the barrel for longitudinal movement between releasably retained extended and retracted positions. In the retracted position (FIG. 1) the cap member 18 covers the flexible portion 16 of the barrel and prevents it from bending, thus rendering the pen as a whole rigid for use. In the extended position (FIG. 2) the cap member 18 leaves the flexible portion 16 exposed and covers the writing tip so that the pen can bend and be put in pockets and small enclosures, such as purses, without danger of getting ink on them or other articles they contain. The barrel 10 is hollow and is configured to accept a standard, commercially available ball point cartridge 20, the ink reservoir 22 of which is flexible and extends up through the barrel to near the head end. A pocket clip 24 is fitted (or formed integrally with) the head portion of the barrel.

On diametrically opposite sides of the tip end portion 12 are rows of helical ribs 26. The ribs 26 of the respective rows are at a constant pitch distance and are located and oriented to define between them vestigial helical threads extending from the juncture 28 between the tip portion and flexible portion of the barrel to a terminus 30 spaced apart from the writing tip. The threads are "vestigial" in that for each full turn of a thread around the barrel there are two substantial gaps where there are no ribs and thus no threads. Instead, the lateral surfaces 32 and 34 are of rounded crosssection, thereby to define a tubular casing for the ink reservoir and, of course, to make the tip portion structurally durable.

At generally the center of the internal wall of the cap member 18 is a circumferential row of spaced apart projections 36. The actual location of the ribs is determined by the length of the flexible portion, inasmuch as the cap member is to be releasably retained in the retracted position in a manner such that it will bridge the flexible portion and provide junctures with the tip end and head end portions of the barrel to make the pen rigid. (It will be apparent, moreover, that the lengths of the tip end portion and flexible portion of the barrel and the cap are functionally interdependant.) The internal wall of the cap member 18 and the external tips of the ribs 26 on the barrel are in sliding fit.

The projections 36 are received in the vestigial threads defined by the ribs. Upon rotation of the cap member, the projections follow the threads and move the cap member longitudinally. At any given point along the stroke of the cap member only some of the projections are received by the threads, while the rest overlie the unthreaded lateral surfaces 32 and 34 of the barrel. It will be apparent that the pitch distance and pitch angle of the threads have to be so related to the number and locations of the projections such that as each projection leaves one thread segment, the next-following projection enters the next-following thread segment. In the embodiment diametrically opposite projections 36 occupy diametrically opposite thread segments at any given point, and the projections and thread segments thus work in pairs.

The releasably retained positions of the cap member are maintained by constrictions in the threads closely adjacent the juncture between the threaded portion and flexible portion of the barrel and adjacent the terminus 30 of the threaded portion. While constrictions of various sorts are possible, and with the scope of the invention (e.g., narrowing of the threads by enlargement of the ribs), it is preferred to provide small beads 38 at the roots of the threads. In addition similar beads 40 can be provided at the extremities of the unthreaded wall portions 32 and 34 for engagement by those protrusions 36 that are not within the threads themselves at the retained positions of the cap member. The beads 38 and 40 are of a height such as to interfere with the inward extremities of the protrusions and require forced rotation of the cap so that it "clicks" into and out of each retained position. The beads are located to maintain the retained positions in conjunction with the landed position of the upper end of the cap against the shoulder of the bead position of the barrel (FIG. 1) and engagement of the protrusions 36 with a tubular retainer member 42 installed on the distal end of the barrel after the cap is threaded onto the barrel. The interference between the beads 38 and 40 and the protrusions 36 produces localized elastic deformations of the barrel and cap member that generate the forces that provide retention of the cap member on the barrel in the retained positions.

Figure 3:
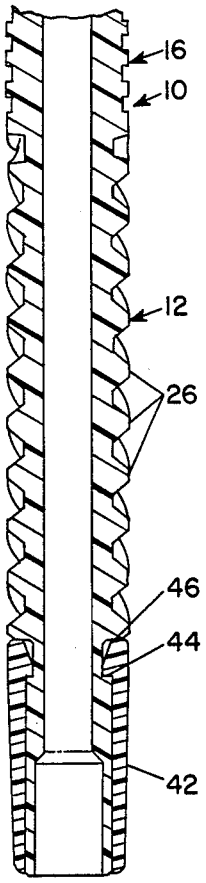
FIG. 3 is a partial front cross-sectional view showing the distal portion of the barrel and the retainer member.
Figure 4:
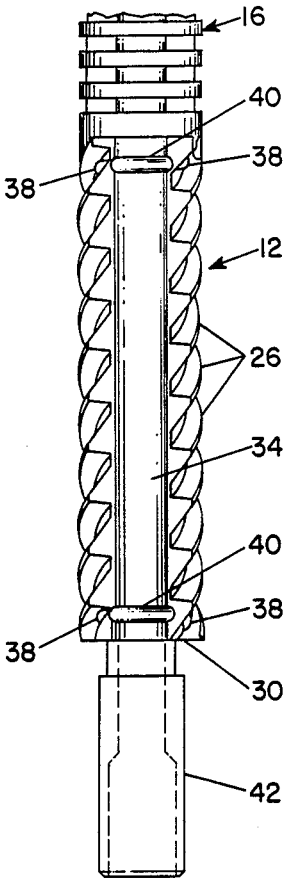
FIG. 4 is a partial front elevational view showing the distal portion of the barrel.

The retainer member 42 has a permanent snap-on shoulder-to-shoulder coupling 44 (See FIG. 3) on the barrel and has an edge 46 defining a stop shoulder to retain the cap member.

Figure 5:
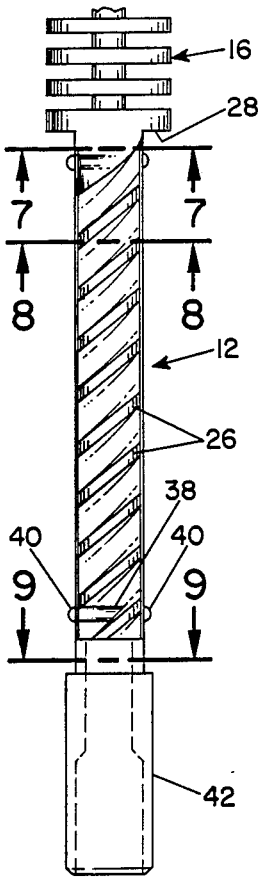
FIG. 5 is a partial side elevational view showing the distal portion of the barrel.
Figure 6:
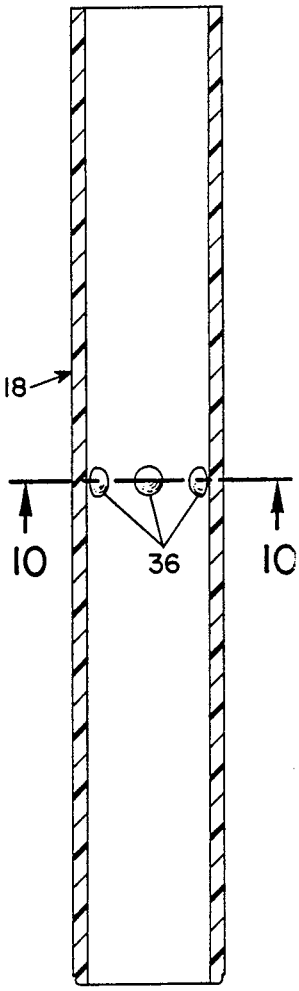
FIG. 6 is a side cross-sectional view of the cap member.
Figure 7:
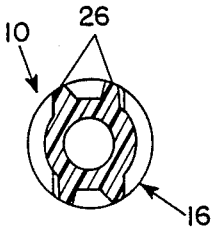
FIGS. 7 to 10 are transverse cross-sectional views taken along the corresponding numbered lines of FIGS. 5 and 6.
Figure 8:
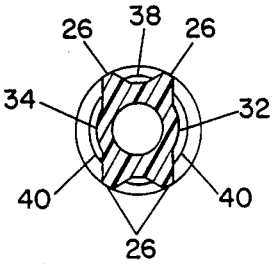
Figure 9:
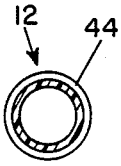
Figure 10:
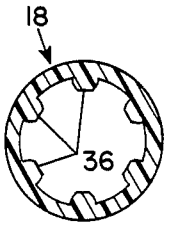

Two opposed movable mold parts that part along a diametrical-longitudinal plane and work in conjunction with a central slender mandrel form the barrel in one piece. The parting plane of the mold parts is parallel to the plane of the paper with respect to FIG. 5. The vestigial thread construction leaves no overhanging of the thread segments that restrict or prevent clean mold separation. Two movable mold parts working coaxially within a bore in a fixed part, parting at the location of the projections, and having mating notches that form the projections likewise provide for clean mold separation and ejection in the production of the cap member.

The present invention can be used with writing tips other than ball points, but the selection of suitable writing elements should be made with attention to the fact that the cap member does not cover the tip hermetically. Therefore, elements that dry out may be of limited usefulness. The invention can also employ short rigid ink cartridges that occupy only the rigid tip end portion of the barrel.

I claim:

1. In a pen having an elongated one-piece barrel having substantially rigid tip end and head end portions, a writing tip affixed at the distal end of the tip end portion, and a substantially rigid tubular cap member telescopically received over the tip end portion of the barrel, the barrel including an integral flexible portion intermediate the tip end and head end portions, whereby the barrel can be bent at the flexible portion, and the cap member being movable along the barrel between (1) a retracted position in which it overlies part of the tip end portion and substantially all of the flexible portion, thus leaving the writing tip exposed and rendering the pen substantially rigid, and (2) an extended position in which it covers the writing tip and leaves the flexible portion exposed, thus protecting the writing tip and rendering the pen flexible, and the cap member and the tip end portion of the barrel having means for releasably retaining the cap member in each of the retracted and extended positions, the improvement wherein the tip end portion of the barrel has a threaded portion extending from a juncture with the flexible portion to a terminus spaced apart from the distal end, the threaded portion having on opposite sides longitudinal rows of spaced-apart helical ribs, the external surfaces of which define a substantially circular cylindrical surface of a diameter in close sliding fit with the internal wall surface of the cap member, the ribs of the respective rows being shaped and located to define vestigial helical threads, and wherein the cap member has at generally its longitudinal center a circumferential row of equally spaced-apart protrusions extending inwardly from its internal wall, the protrusions being adapted to be received sequentially in the vestigial threads to engage and follow them and provide controlled longitudinal movement of the cap member along the threaded portion upon rotation of the cap member.

2. The improvement according to claim 1 wherein the means for releasably retaining the cap member in the respective retracted and extended positions consists of constrictions in the vestigial threads closely adjacent the ends thereof, the constrictions being in interference fit with the protrusions such as to require forced elastic deformations of portions of the cap member and barrel to enable the protrusions to pass the constrictions.

3. The improvement according to claim 2 wherein the constrictions are provided by shallow parts of the threads that force elastic stretching of the cap member in the region of the protrusions to enable the protrusions to pass the constrictions.

4. The improvement according to claim 2, and further comprising a tubular retainer member received on the tip end portion of the barrel and defining a shoulder at the terminus of the threaded portion that blocks the distal ends of the threads and prevents removal of the cap member by engagement with the protrusions of the cap member when it is in the extended position.

* * * * *